US005158503A

United States Patent [19]

Mitchell

[11] Patent Number: 5,158,503

[45] Date of Patent: Oct. 27, 1992

[54] DOUBLE-PIVOT DOOR HINGE FOR APPLIANCE DOORS

[75] Inventor: Terry L. Mitchell, Jenison, Mich.

[73] Assignee: White Consolidated Industries, Inc., Cleveland, Ohio

[21] Appl. No.: 616,862

[22] Filed: Nov. 21, 1990

[51] Int. Cl.[5] ..... E05F 1/08; E05D 3/06

[52] U.S. Cl. ..... 16/278; 16/302; 16/308; 16/366

[58] Field of Search ..... 16/256, 277, 278, 287, 16/302, 308, 319, 374, 307, 366, 368, 371

[56] References Cited

U.S. PATENT DOCUMENTS

| | | | |
|---|---|---|---|
| 2,183,210 | 12/1939 | Anderson | 16/278 |
| 2,867,839 | 1/1959 | Squire | 16/358 |
| 3,335,454 | 8/1967 | Dunster, Jr. | 16/278 |
| 3,510,986 | 5/1970 | Berkowitz | 16/256 |

FOREIGN PATENT DOCUMENTS

| | | | |
|---|---|---|---|
| 977097 | 2/1965 | Fed. Rep. of Germany | 16/366 |
| 1564908 | 4/1969 | France | 16/366 |

*Primary Examiner*—Robert L. Spruill
*Assistant Examiner*—Donald M. Gurley
*Attorney, Agent, or Firm*—Pearne, Gordon, McCoy & Granger

[57] ABSTRACT

A double-pivot door hinge is disclosed that is particularly suited for household appliances such as refrigerators or microwave ovens. The hinge arrangement allows the appliance door to be opened a full 180 degrees from its closed position without coming into contact with a flush mounted wall such as an abutting kitchen cabinet. The hinge has a first pivot pin and a stop arrangement which allows a door to be swung outwardly until a 90-degree position is reached whereby the stop arrangement is engaged. Upon further outward movement, the assembly shifts to a second hinge pin until a 180-degree position is reached. The movement from the 90-degree position to a 180-degree position requires the overcoming of a spring force of the hinge arrangement.

10 Claims, 5 Drawing Sheets

DOUBLE-PIVOT DOOR HINGE FOR APPLIANCE DOORS

BACKGROUND OF THE INVENTION

The present invention relates to hinge structures and, more particularly, to a double-pivot door hinge that allows an appliance door, such as for a refrigerator or a microwave oven, to be opened to a 180-degree position without causing the door to contact a flush mounted wall such as an abutting kitchen cabinet.

In conventional appliance door hinges, the door is hingedly secured to the front corner of the cabinet of the appliance. When the door is opened, it normally extends beyond the side of the cabinet by an amount equal to the thickness of the door. In certain places in a room where the appliance, such as a refrigerator, is placed, a wall of the room may be abutting against the side wall of the refrigerator. Such a placement makes it impossible for the door to be opened to a full 90-degree position. More particularly, when the cabinetry of the kitchen comes flush with the forward side edge of the door, the door cannot be opened 180 degrees. Such interference problems can be corrected by a double-pivot hinge arrangement.

Double-pivot hinge arrangements for refrigerators are well-known and one such arrangement is disclosed in U.S. Pat. No. 2,867.839 of H. D. Squire. The hinge arrangement of the '839 patent provides a first pivot point about which the door is swung from its closed to its 90-degree position, and then the hinge arrangement shifts to a second pivot point, allowing the door to be swung from its 90-degree position to its fully-opened 180-degree position, complete movement of the door from its closed to its fully opened position is accomplished without any interference with the flush mounted cabinetry of the kitchen.

The hinge arrangement of the '839 patent allows the door to be moved from its closed position by applying a substantially constant force. Such a constant force may not take into account that the movement should be hindered somewhat, especially when the door approaches its fully-opened position; otherwise, the door may encounter an unforeseen obstruction or the hinge may be moved past its designed position. It is desired that a hinge arrangement be provided that allows the door to be freely moved from its closed to its 90-degree position, but that the movement of the door from the 90-degree to the 180-degree position be hindered and require a deliberate force to overcome such hindrance.

Accordingly, it is an object of the present invention to provide a double-pivot hinge assembly requiring a first force to cause movement of the related door from its closed to its 90-degree position, and then a second and deliberate force to move the door from its 90-degree position to its fully-opened 180-degree position.

It is a further object of the present invention to provide a double-pivot hinge structure which is relatively inexpensive to manufacture and assemble in light of the highly cost-competitive nature of the domestic appliance industry.

SUMMARY OF THE INVENTION

In accordance with the present invention, a double hinge arrangement is provided for pivotally mounting a door of an appliance, such as a refrigerator or microwave oven.

The hinge assembly is located on the upper and lower portions of each of the doors of the related appliance. The hinge assembly comprises a first hinge pin, a forwardly extending support member having a first stop member, a second hinge pin, a link member, yielding means, and a housing for the yielding means. The link member has first and second apertures spaced apart from each other and having complementary dimensions so as to respectively receive the first and second hinge pins. The link member further has an extending region that serves as a second stop member. A torsion spring serves as the yielding means and has a laterally extending portion along with a vertically extending portion. The housing member receives the torsion spring, and has a first aperture for receiving and confining the vertically extending portion and a second aperture for receiving the second hinge pin. A lost motion means prevents stressing the spring in the first 90 degrees.

In operation, upon the rotation of the appliance door from its closed to its fully-opened position, the door is first pivoted about the first hinge pin until the 90-degree position of rotation is reached, which causes the second stop member to engage the first stop member and the lost motion means prevents stressing the spring. Any further movement from the 90-degree to the 180-degree position causes the hinge assembly to shift from the first hinge pin to the second hinge pin. The further movement causes the door to be pivoted about the second hinge pin, which ensures that the door does not have any interference with any abutting cabinet. This further movement of the door is controlled by the torsion spring of the yielding means, which is stressed to hinder any further rotation of the door unless it is overridden by a deliberate force.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
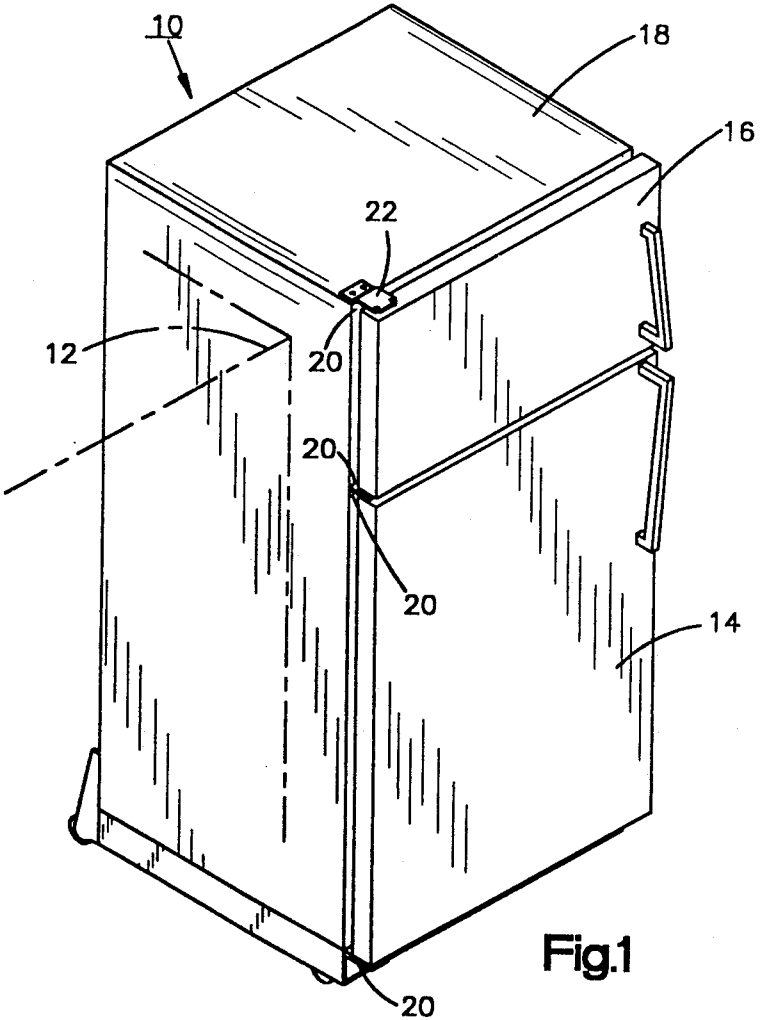
FIG. 1 is a perspective view of a refrigerator rolled forwardly away from a closely located and abutting kitchen cabinet.

With reference to FIG. 1 of the drawings, an appliance such as a refrigerator 10 of the domestic type is illustrated. The refrigerator 10 is illustrated as moved outward and forwardly away from its normal position, that being a flush mounted arrangement with a kitchen cabinet 12.

The refrigerator 10 includes a first door 14 and a second door 16 pivotally mounted on a refrigerator cabinet 18. The cabinet 18 is divided into two compartments, namely, the refrigerator compartment accessible via the first or refrigerator door 14, and a second, small freezer compartment, accessible by the second or freezer door 16. The refrigerator door 14 pivots, between the open and closed position, about vertical axes provided by a door upper-hinge assembly 20 and related lower-hinge assembly 20. In a similar fashion, the freezer door 16 pivots, between the open and closed position, about vertical axes provided by a freezer door upper-hinge assembly 20 and a lower-hinge assembly 20. The lower and upper hinge assemblies 20 for the doors 14 and 16 are substantially the same except for mounting adaptations to the cabinet that are well-known in the art. The hinge assembly 20 mounted to the upper portion of cabinet 18 is to be described with the understanding that the features of this upper-hinge are equally applicable for use at other hinge locations on the cabinet 18. The hinge assembly 20 is of prime importance to the present invention and is further illustrated in FIG. 2.

Figure 2:
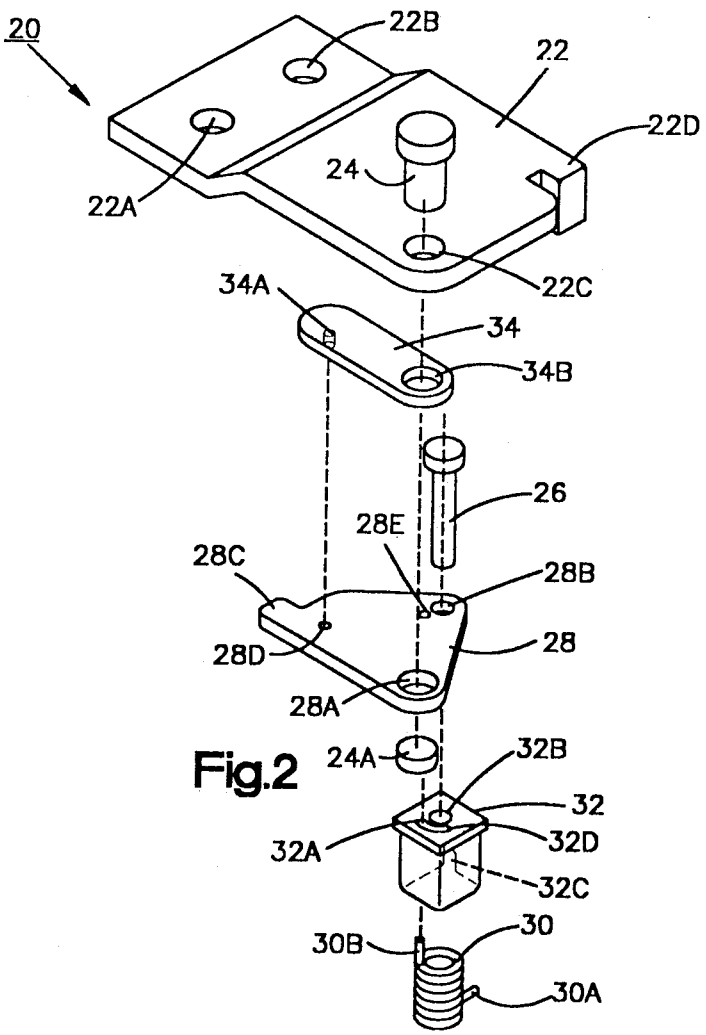
FIG. 2 is an exploded perspective view, illustrating the construction of the double hinge of the present invention.

FIG. 2 is an exploded, perspective view illustrating the construction of the hinge assembly 20. The hinge assembly 20 comprises a support member 22, a first hinge pin 24, a second hinge pin 26, a link member or pivotable plate 28, yielding means 30, and a housing member 32. Further, the hinge assembly preferably comprises a spacer member 34.

The support member 22 is affixed to the cabinet 18 (shown in FIG. 1) at the side position thereof, and extends forwardly therefrom The support member of FIG. 2 may be affixed by suitable means such as rivets inserted through openings 22A and 22B. The support member 22 has a first aperture 22C for receiving the first hinge pin 24 and a first stop member 22D that is spaced apart and relative to the aperture 22C.

The link member 28 has first and second apertures 28A and 28B that are parallel to each other and spaced apart from each other. The apertures 28A and 28B have respective complementary dimensions so as to receive the first and second hinge pins 24 and 26. The link member 28 has an extending region 28C that serves a second stop member and cooperates with stop member 22D after a lost motion arc of 90 degrees. The link member 28 has an aperture 28D that accepts a connecting pin 34A of spacer 34.

The yielding means 30 is preferably comprised of a torsion spring formed in a coil arrangement and having first end or a laterally extending portion 30A along with a second end or vertically extending portion 30B. The torsion spring 30 is received by and confined within housing member 32 preferably having a rectangular shape to fit in a similarly shaped hole in the door 14. The member 32 has a 90° arcuate aperture 32A for receiving and confining the vertically extending portion 30B and a second aperture 32B for receiving the second pivot pin 26.

In the assembly of hinge pin arrangement 20, the torsion spring 30 is inserted into the housing 32 and the second hinge pin 26 is inserted into and through aperture 28B and then into aperture 32B. The spacer 34 is mated to the link member 28 by means of a pin 34A that emerges from the bottom side of spacer 34 and is inserted into aperture 28D. The first hinge pin 24 is inserted into aperture 22C, then into aperture 34B and finally into aperture 8A. The first hinge pin 24 may be fixed within its related apertures by means of member 24A or by a suitable rivet arrangement. The placement of the hinge assembly 20 within the refrigerator door is illustrated in FIG. 3.

Figure 3:
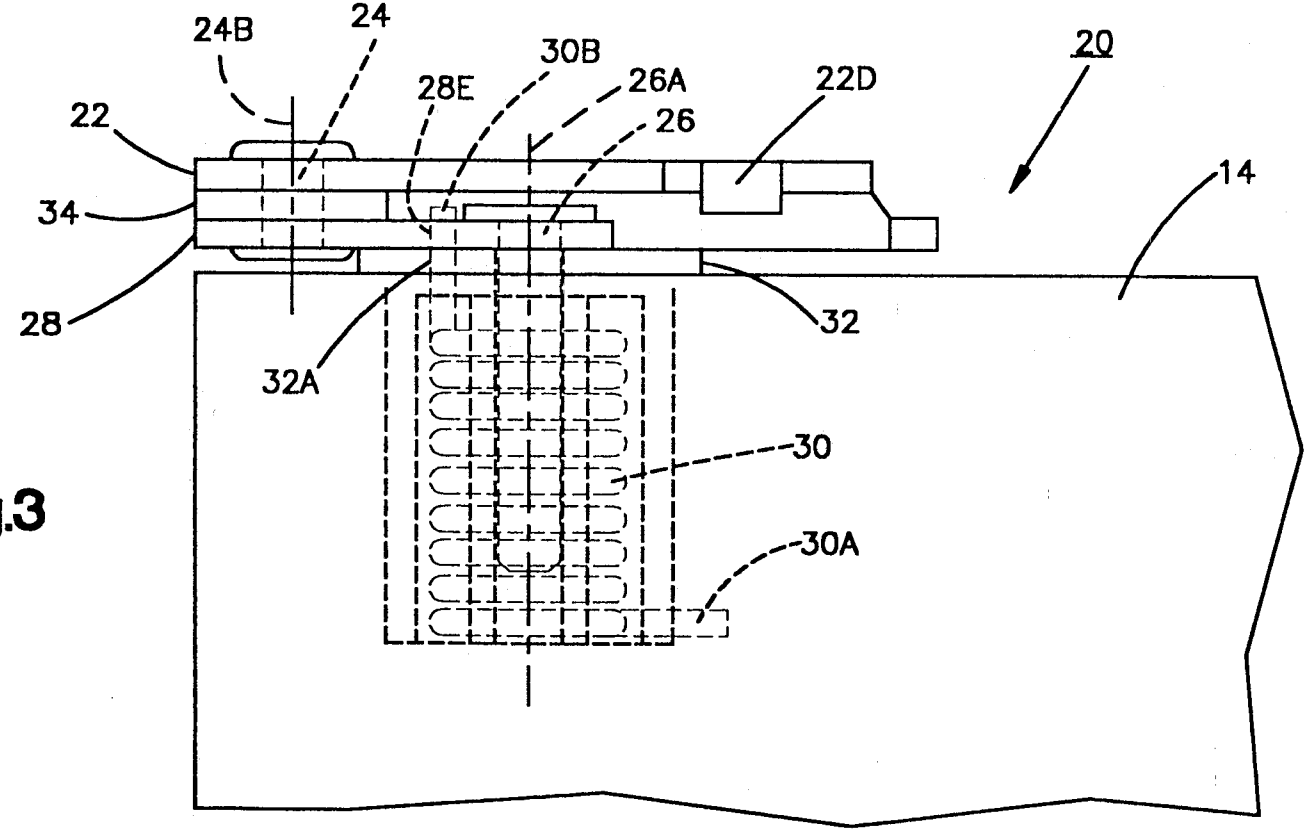
FIG. 3 illustrates the placement of the double hinge arrangement in the refrigerator door.

FIG. 3 shows the support member 22, spacer 34, and link member 28 fastened together by means of the first hinge pin 24 having a centerline 24B. The second hinge pin 26 has a centerline 26A and is shown as centrally located within the coils of the torsion spring 30. The portion 30B of the torsion coil is inserted into and extending from apertures 32A and 28E. For the embodiment shown in FIG. 3, the portion 30A is extending through a channel 32C located on the side of the housing 32 which is fixed in the door. The channel confines the portion 30A within the housing 32. For another embodiment, the portion 30A is arranged to bear against the inside of the door to prevent any movement thereof except movement with the door.

The refrigerator 10 of FIG. 1 may be pushed back into its normal position in a kitchen so that it abuts against and is flush mounted with the kitchen cabinet 12. Such flush mounting is partially shown in FIGS. 4*a* to 6*b*, to be discussed hereinafter. Such an arrangement, without the benefits of a double hinge door hinge, would cause the flush mounted cabinet to impede and interfere with the rotation of the doors 14 and 16. As discussed in the "Background of the Invention" section, double-pivot hinged arrangements, such as disclosed in U.S. Pat. No. 2,867,839, correct for the interference problem of a flush mounted cabinet. The double hinge arrangement of the present invention not only corrects for the interference problem, but also provides the movement of the door from its 90-degree to its 180-degree positions to be accomplished by a deliberate force that must override the spring action of the torsion member 30. Such a deliberate force negates the problem discussed in the "Background" section of the door's being unintentionally rotated beyond its designed fully-opened position.

Figure 4B:
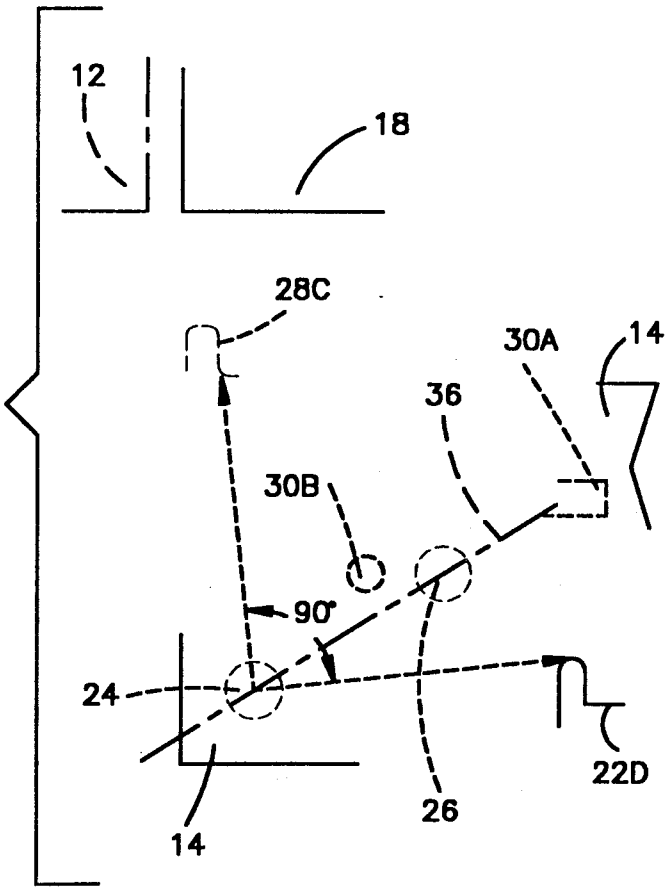
FIGS. 4*a* and 4*b* are both related to illustrating the closed position of the refrigerator door and respectively illustrate the arrangement of the elements of the hinge assembly within the door at this position, and to a simplified showing of the hinge assembly associated with the pivoting action of the present invention.
Figure 4A:
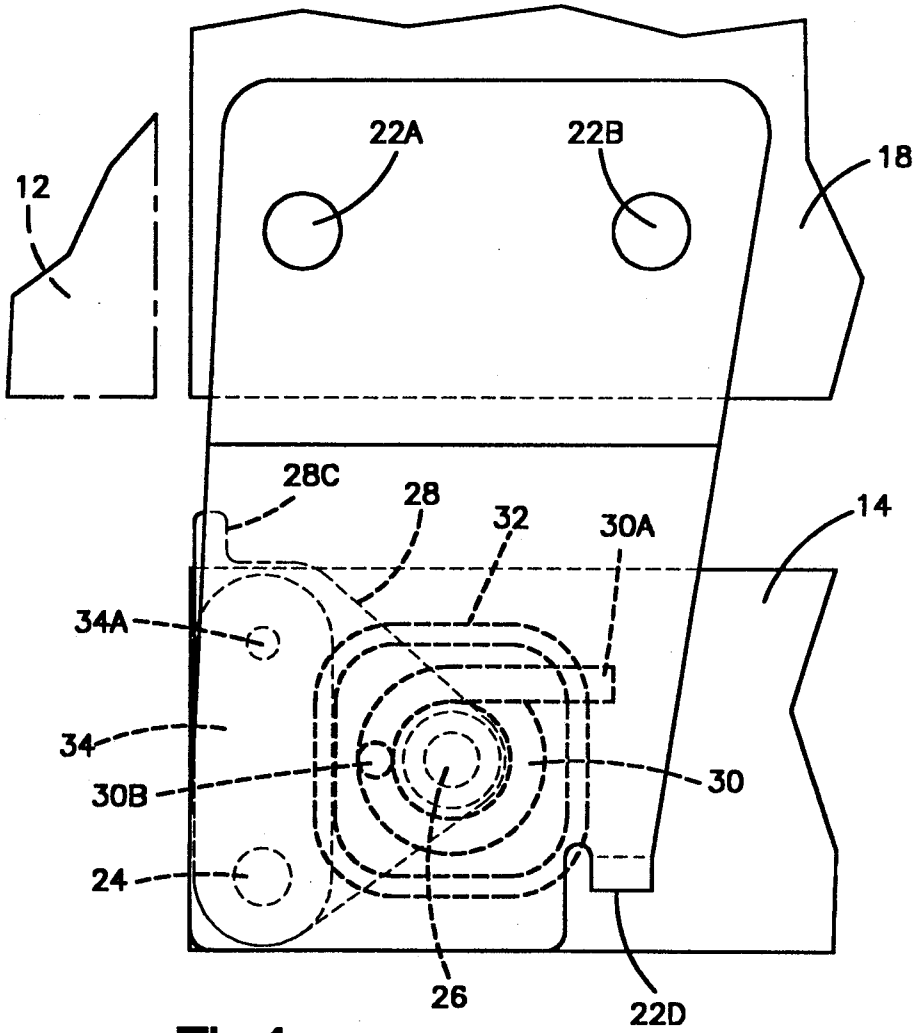
Figure 5B:
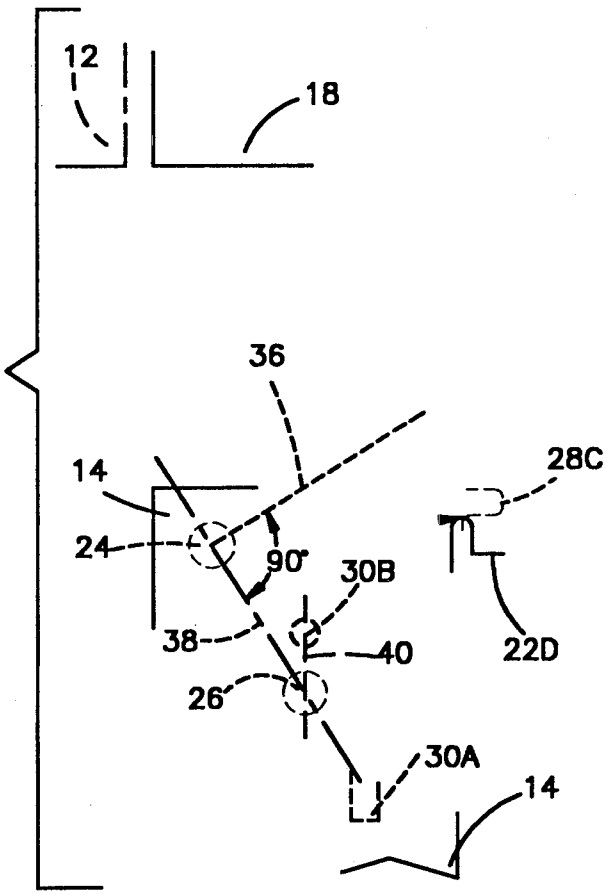
FIGS. 5*a* and 5*b* are both related to illustrating the 90-degree position of the refrigerator door and respectively illustrate the arrangement of the hinge assembly within the door at this position, and to a simplified showing of the hinge assembly associated with the pivoting action of the present invention.
Figure 5A:
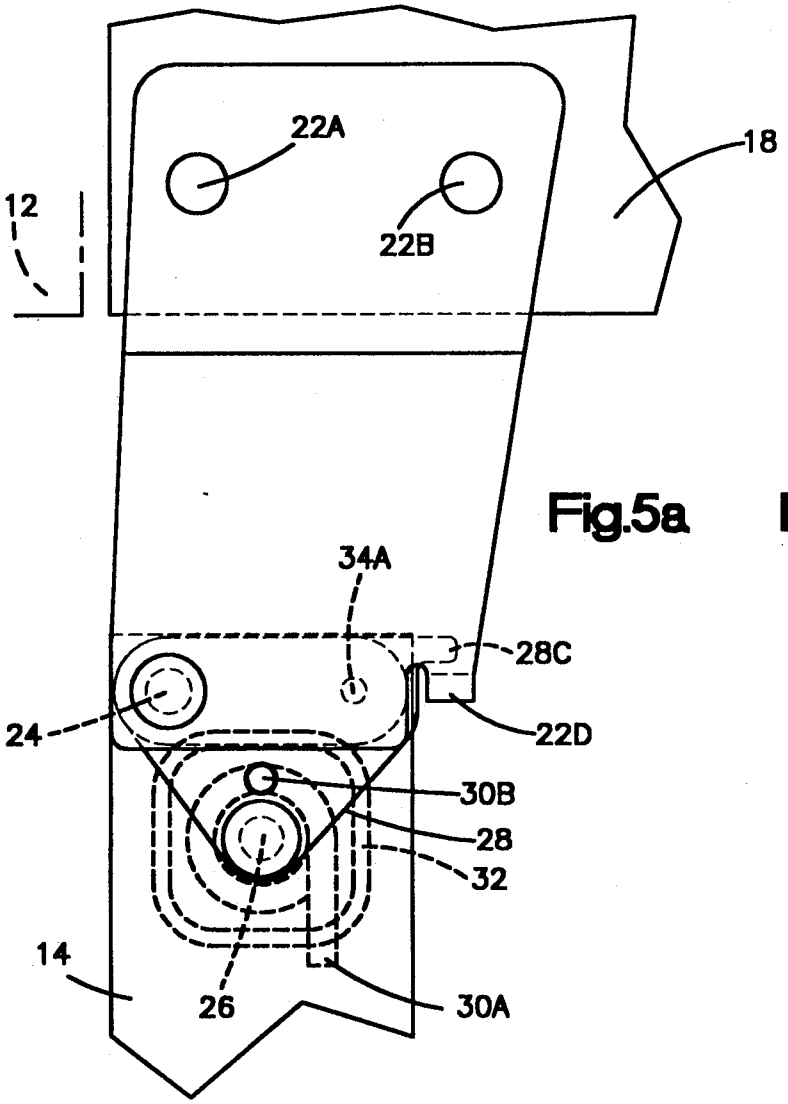

The operation of the hinge assembly 20 may be described with reference to FIGS. 4*a* to 6*b* in sequence, starting with FIG. 4*a*. FIG. 4*a* illustrates in detail the at-rest condition of a hinge arrangement 20 within the door 14, whereas, FIG. 4*b* is a simplified illustration showing the essential elements of the hinge arrangement 20 relative to its pivotal action. FIGS. 4*a* and 4*b*, along with FIGS. 5*a* to 6*b*, show the cabinet 18 close against, and almost flush with, the kitchen cabinetry 12. The door 14 in its at-rest condition is parallel with the cabinet 18. Further, as shown in FIG. 4*b*, it is seen that the first hinge pin 24 and the second hinge pin 26 are parallel and disposed along reference line 36. Also, as shown in FIG. 4*b*, it is seen that the first stop member 22D is displaced by a predetermined lost motion amount of 90 degrees about the hinge pin 24 relative to the second stop member 28C. The portions 30A and 30B of the yielding means 30 are shown in their inoperative or at-rest condition. As the door is opened, it pivots about hinge pin 24 and the hinge assembly allows it to swing outwardly until the first and second stop members 22D and 28C become engaged, as shown in FIGS. 5*a* and 5*b*. The lost motion means precludes stressing of the spring during this first 90 degree pivoting.

FIGS. 5*a* and 5B are similar to FIGS. 4*a* and 4*b*, but illustrate the 90-degree open position of the door 14. A comparison between FIGS. 4*a* and 4*b* relative to FIGS. 5*a* and 5*b* reveals that the position of hinge pin 24 within door 14 and relative to cabinet 18 remains the same, whereas, the second hinge pin 26 has been displaced 90 degrees relative to hinge pin 24, although the first hinge pin 24 and second hinge pin 26 are still parallel but now along reference line 38. Further, the movement of the door 14 causes the portions 30A and 30B, now at their 90-degree position, to be displaced 90 degrees relative to their at-rest positions shown in FIGS. 4*a* and 4*b*, and with no stressing of the spring, due to the lost motion. The position of door 14 of FIGS. 5*a* and 5*b* is now perpendicular, or 90 degrees relative to the cabinet 18. The movement of the door 14 to its 90-degree position has caused the engagement of stops 22D and 28C. and any further movement of the door 14 beyond this 90-degree position causes the pivot point of the door to shift from first hinge pin 24 to second hinge pin 26. Any further rotation beyond this 90-degree position requires a force to stress the spring action of the yielding means 30.

Figure 6B:
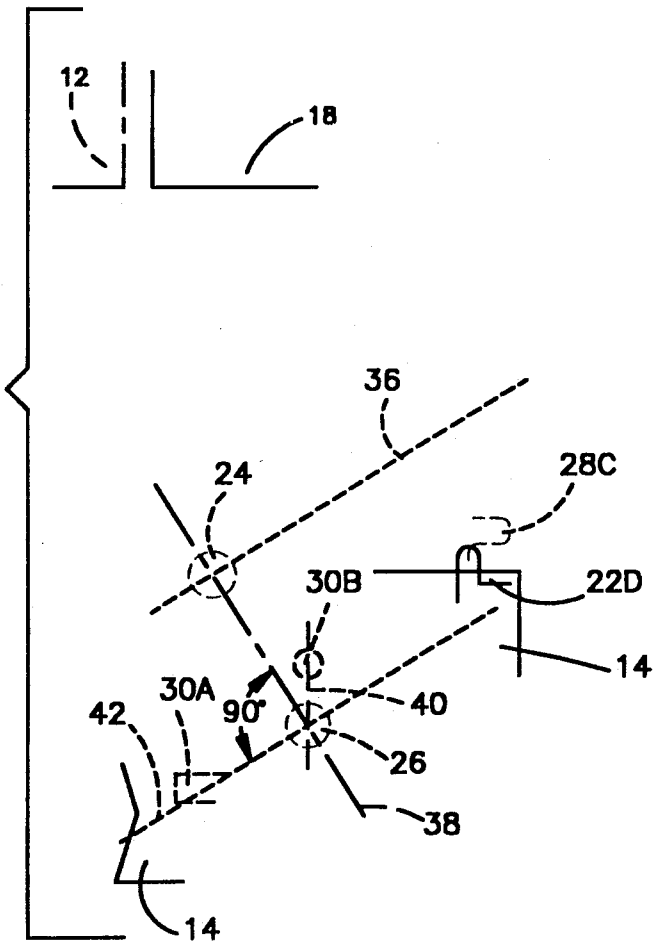
FIGS. 6*a* and 6*b* are both related to illustrating the 180-degree position of the refrigerator door and respectively illustrate the arrangement of the hinge assembly within the door at this position, and to a simplified showing of the hinge assembly associated with the pivoting action of the present invention.
Figure 6A:
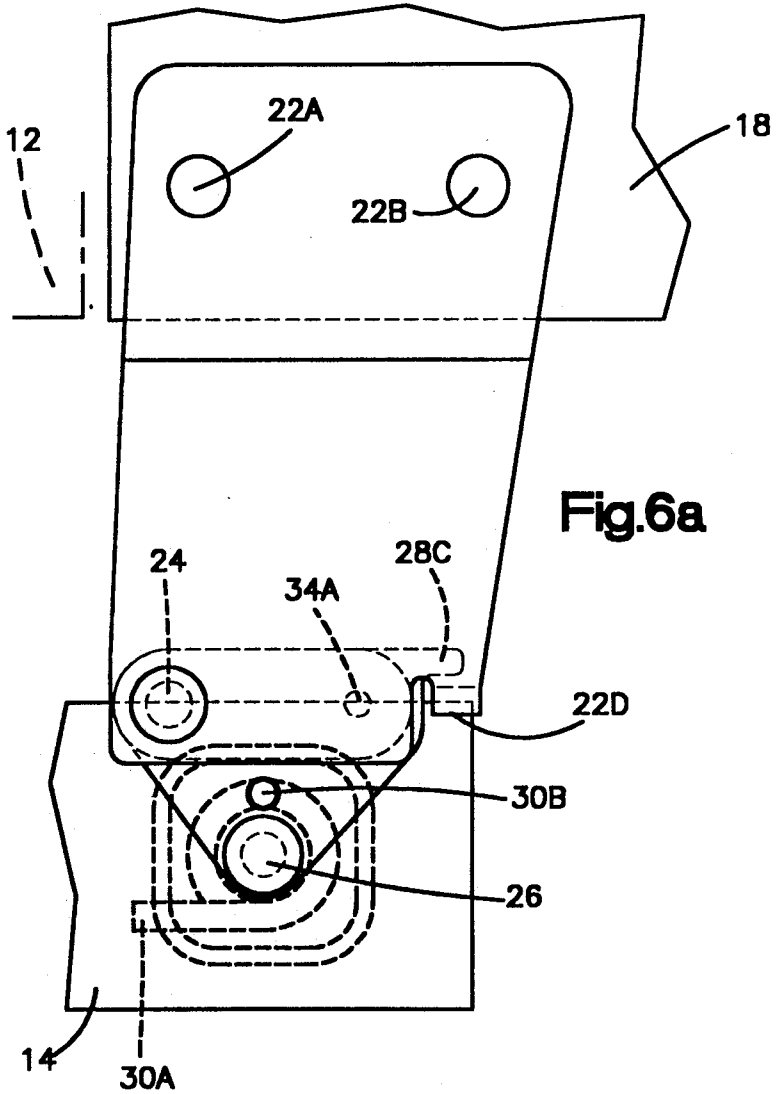

The pivoting action of the door 14 from its 90-degree to its 180-degree position is shown by a comparison between FIGS. 5*a* and 5*b* relative to FIGS. 6*a* and 6*b*. FIG 5*b* shows the portion 30B as being located above and parallel with hinge pin 26 along reference line 40, whereas, portion 30A is intersected by reference line 38, which extends between the first hinge pin 24 and the second hinge pin 26. FIG. 6*b* shows that portion 30B has maintained the position of FIB. 5*b*, by being held by link 28, of alignment with second hinge pin 26, but portion 30A of FIG. 6*b* is now along reference line 42, which is displaced from reference line 38 by a 90-degree amount. As housing 32 turns from the 90° to the 180° position, arcuate slot 32A also turns so that the opposite end 32D of the slot is at spring-end 30B. From such a comparison, it is determined that the torsion spring 30 is stressed and controls the movement of door 14 and such movement is pivoted about the second hinge pin 26.

The amount of force to cause the movement from the 90-degree position of FIGS. 5*a* and 5*b* to the 180-degree position of FIGS. 6*a* and 6*b* is the amount necessary to stress the spring action of the member 30. Such a force must be a deliberate force controlled by an operator, which thereby prevents any unintentional movement that might otherwise cause some unforeseen damage to the door 14 or the kitchen cabinet 12, as discussed in the "Background" section.

It should now be appreciated that the practice of the present invention provides a double hinge pin arrangement that not only overcomes the interference problem related to a flush mounted cabinetry, but also allows the positioning of the door from its 90-degree to its 180-degree position to be controlled by a deliberate force so as to prevent any unintentional movement of the door between these positions.

It should now be appreciated that the practice of the present invention provides for a double hinge arrangement having a springlike member that controls the movement of the door from its 90-degree position to its 180-degree position.

The hinge assembly 20 in accordance with the invention as discussed is relatively inexpensive and provides highly reliable service. Further, the hinge assembly 20 is relatively inexpensive to manufacture so as to meet the competitive requirements of the domestic appliance industry.

Although the preferred embodiment of this invention has been shown and described, it should be understood that various modifications and rearrangements of the parts may be accomplished without departing from the scope of the invention as disclosed and claimed herein.

What is claimed is:

1. A hinge assembly for pivotally mounting an appliance door on an associated cabinet, comprising:

a first hinge pin;

a support member affixed to the cabinet on one side thereof and extending forwardly of the cabinet, said support member having a first aperture for receiving said first hinge pin and a first stop member, said hinge pin and said stop member being spaced from each other;

a second hinge pin;

a link member having first and second apertures being parallel and spaced from each other and having complementary dimensions to respectively receive said first and second hinge pins, said link member being pivotally mounted on said first hinge pin and further having an extending region serving as a second stop member;

a yielding means having a laterally extending portion and a vertically extending portion; and a housing member rotationally fixed in the appliance door for receiving said yielding means, said housing member having a first aperture for receiving and confining said vertically extending portion and a second aperture for receiving said second hinge pin;

said laterally extending portion being secured to one of said housing and the appliance door;

whereby upon rotation of said appliance door from its closed to its fully opened position said door is first pivoted about said first hinge pin until a first predetermined position is reached which causes the second stop member to engage the first stop member, and then any further movement of said door is pivoted about said second hinge pin and said yielding means tends to hinder any such further movement or rotation of said door.

2. The hinge assembly according to claim 1, wherein said first predetermined position is displaced 90 degrees from said closed position and said first and second stop members are displaced 90 degrees relative to each other when said door is in its closed position.

3. The hinge assembly according to claim 1, wherein said yielding means is a torsion spring.

4. The hinge assembly according to claim 1, wherein said housing member has a rectangular shape.

5. The hinge assembly according to claim 1, wherein said housing member has a third aperture for receiving and confining said laterally extended portion of said yielding means.

6. The hinge assembly according to claim 1, wherein said laterally extended portion of said yielding means is positioned to bear against the inside of said appliance door.

7. The hinge assembly according to claim 1, further comprising a spacer member positioned between said support member and said link member, said spacer member having an aperture for receiving said first hinge pin and means for connecting to said link member.

8. A hinge assembly for pivotally mounting an appliance door on an associated cabinet, comprising:

a first hinge pin;

a support member affixed to the cabinet on one side thereof and extending forwardly of the cabinet, said support member having a first aperture for receiving said first hinge pin;

a second hinge pin;

means including said support member to mount said first and second hinge pins, parallel and spaced from each other;

a yielding means having first and second ends with said first end being fixed relative to the appliance door;

a housing member for receiving said yielding means;

lost motion means coacting with said mounting means and said yielding means in the stressing of said yielding means between said first and second ends thereof;

a first stop member on said support member; and a second stop member on said mounting means engageable with said first stop member to establish a first predetermined position as a limit to said lost motion means;

whereby upon rotation of said appliance door from its closed to its fully open position said door is first pivoted about said first hinge pin until said first predetermined position is reached with said lost motion means preventing stressing of said yielding means, and then any further movement of said door is pivoted about said second hinge pin and said yielding means is stressed to hinder any such further movement or rotation of said door.

9. A hinge assembly as set forth in claim 8, wherein said second stop member is on a pivotable plate of said mounting means.

10. A hinge assembly as set forth in claim 9, wherein said pivotable plate is positioned between said support member and said housing.

* * * * *

UNITED STATES PATENT AND TRADEMARK OFFICE

CERTIFICATE OF CORRECTION

PATENT NO. : 5,158,503

DATED : October 27, 1992

INVENTOR(S) : Terry L. Mitchell

It is certified that error appears in the above-identified patent and that said Letters Patent is hereby corrected as shown below:

Column 1, line 28, delete "2,867.839" and insert --2,867,839--.

Column 3, line 42, after "therefrom" insert --.-- (period) .

Column 4, line 9, delete "8A" and insert --28A--.

Column 5, line 21, delete "28C." and insert --28C,--.

Column 5, line 31, after "FIG" insert --.-- (period).

Signed and Sealed this

Thirtieth Day of November, 1993

Bruce Lehman

*Attest:*

BRUCE LEHMAN

*Attesting Officer*

*Commissioner of Patents and Trademarks*